US010344576B1

(12) United States Patent
Hou et al.

(10) Patent No.: US 10,344,576 B1
(45) Date of Patent: Jul. 9, 2019

(54) METHOD USED FOR EXPLOITING NATURAL GAS HYDRATE RESERVOIR

(71) Applicant: CHINA UNIVERSITY OF PETROLEUM (EAST CHINA), Shandong (CN)

(72) Inventors: Jian Hou, Qingdao Shandong (CN); Yongge Liu, Qingdao Shandong (CN); Kang Zhou, Qingdao Shandong (CN); Qingjun Du, Qingdao Shandong (CN); Yajie Bai, Qingdao Shandong (CN); Yunkai Ji, Qingdao Shandong (CN); Nu Lu, Qingdao Shandong (CN); Wenbin Wang, Qingdao Shandong (CN)

(73) Assignee: CHINA UNIVERSITY OF PETROLEUM (EAST CHINA) (CN)

( * ) Notice: Subject to any disclaimer, the term of this patent is extended or adjusted under 35 U.S.C. 154(b) by 0 days.

(21) Appl. No.: 16/215,255

(22) Filed: Dec. 10, 2018

(51) Int. Cl.

| | |
|---|---|
| ***E21B 43/24*** | (2006.01) |
| ***E21B 43/30*** | (2006.01) |
| ***E21B 47/00*** | (2012.01) |

(52) U.S. Cl.
CPC ..... *E21B 43/24* (2013.01); *E21B 43/305* (2013.01); *E21B 47/00* (2013.01)

(58) Field of Classification Search
CPC ..... E21B 2043/0115; E21B 43/006; E21B 43/14; E21B 43/01; E21B 43/24; E21B 36/00
See application file for complete search history.

(56) References Cited

U.S. PATENT DOCUMENTS

| | | | | |
|---|---|---|---|---|
| 7,198,107 | B2 * | 4/2007 | Maguire | E21B 43/247 166/272.2 |
| 8,232,438 | B2 * | 7/2012 | Jones | E21B 43/34 585/15 |
| 2015/0090455 | A1 * | 4/2015 | Balczewski | E21B 43/24 166/303 |

* cited by examiner

*Primary Examiner* — Yong-Suk Ro
(74) *Attorney, Agent, or Firm* — Calfee, Halter & Griswold LLP

(57) ABSTRACT

The example of implementation of the invention provides a method used for exploiting a natural gas hydrate reservoir and belongs to the field of natural gas hydrate reservoir exploitation. The method mainly comprises a heat-injecting vertical well and a production horizontal well. The production horizontal well is opened in a segmental manner. In combination with natural gas hydrate heat exploitation, heat flow injected into the vertical well is enabled to heat different positions of the natural gas hydrate reservoir to increase a recovery ratio of the natural gas hydrate reservoir. The method specifically comprises the steps of injecting a heat flow into the natural gas hydrate reservoir by utilizing the vertical well to promote decomposition of the hydrate; firstly opening a horizontal branch of the horizontal well fully and keeping depressurization exploitation. When gas production amount is reduced to a certain degree, dividing a segmentation number based on permeability of the natural gas hydrate reservoir and performing segmental exploitation on the horizontal branch from a toe end to a heel end to realize heat exploitation of the heterogeneous natural gas hydrate reservoir. The method makes full use of a horizontal well structure, reduces exploitation cost and provides effective measures for efficient exploitation of the heterogeneous natural gas hydrate reservoirs.

6 Claims, 1 Drawing Sheet

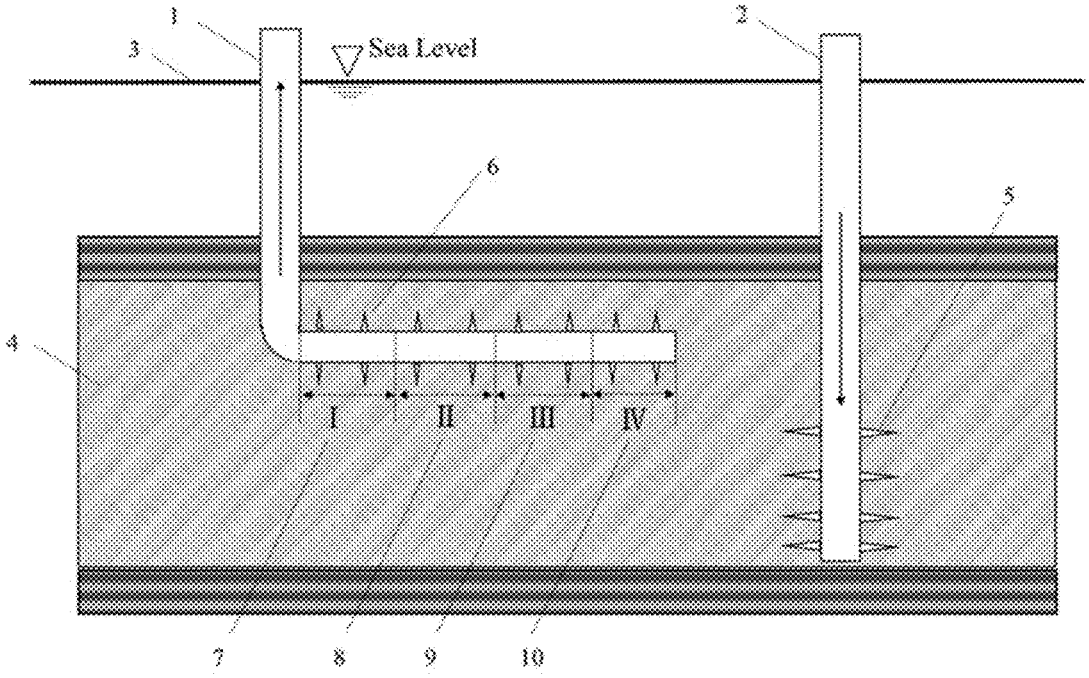
1
2
3
Sea Level
6
5
4
I
II
III
IV
7
8
9
10

METHOD USED FOR EXPLOITING NATURAL GAS HYDRATE RESERVOIR

CROSS REFERENCE TO RELATED APPLICATIONS

This application claims priority to Chinese Application No. 201810721969.6, filed on Jul. 4, 2018, entitled "METHOD OF EXPLOITING HETEROGENEOUS NATURAL GAS HYDRATE RESERVOIR BY USING SEGMENTED PERFORMED HOLE OF HORIZONTAL WELL", and all the content of the Chinese application is referred to as a reference and is combined thereto.

FIELD OF THE INVENTION

The invention relates to the field of exploitation of natural gas hydrate reservoirs, and specifically to a method used for exploiting a natural gas hydrate reservoir.

BACKGROUND OF THE INVENTION

The natural gas hydrate, an unconventional gas resource, is paid widespread attention and researched by people in the world by virtue of the advantages of wide distribution, multiple types, big reserves and big energy density. Under the condition that difficulty in exploitation and utilization of traditional fossil energy resource rises at the current state, the natural gas hydrate is generally accepted as one of the most promising new efficient clean energies and has huge exploitation potential.

In a high-pressure and low-temperature environment, the natural gas and water may form a natural gas hydrate; when the condition for the existence of the natural gas is damaged, that is to say, the temperature rises at a given pressure or the pressure is dropped at the given temperature, the natural gas hydrate decomposes; the exploitation of the natural gas hydrate is to damage the phase balance of the natural gas hydrate to decompose the natural gas hydrate into natural gas and water for exploitation. In the exploitation of the natural gas hydrate, the horizontal well can enlarge the contact area efficiently, expand the decomposition range of the natural gas hydrate and accordingly increase the gas production rate; however, due to heterogeneity of the natural gas hydrate reservoir, a channeling phenomenon happens easily in the heat-injecting exploitation process, and the exploitation efficiency of the natural gas is affected seriously.

SUMMARY OF THE INVENTION

The invention aims at providing a method used for exploiting a natural gas hydrate reservoir. The method can greatly increase the recovery ratio of the natural gas hydrate reservoir, reduce the exploitation cost and provide effective measures for efficient exploitation of the heterogeneous natural gas hydrate reservoir.

In order to realize the purpose, a method used for exploiting the natural gas hydrate reservoir is provided. The method comprises the steps of controlling a heat flow to enter a vertical well at a pre-set rate, the vertical well drills through the natural gas hydrate reservoir and comprises a vertical well perforation segment and communicates with the natural gas hydrate reservoir through the vertical well perforation segment; controlling a horizontal well to exploit the natural gas hydrate reservoir at a pre-set well bottom pressure, wherein the pre-set well bottom pressure is lower than an original pressure of the natural gas hydrate reservoir by a pre-set pressure, the horizontal well is located at one side of the vertical well, a horizontal branch of the horizontal well comprises a horizontal well perforation segment and communicates with the natural gas hydrate reservoir through the horizontal well perforation segment; when a gas volume produced by the horizontal well is lower than a pre-set gas volume, segmenting the horizontal branch and determining length of each segment of the horizontal branch based on a permeability distribution of the natural gas hydrate reservoir and clustering analysis method, wherein the number of the segmented segments is a pre-set value; controlling perforated holes included in a first segment of the horizontal branch which is closest to the vertical well to be in an open state and controlling perforated holes included in other segments, except for the first segment, to be in a closed state; and starting from the first segment, controlling opening and/or closing state of the perforated holes included in each segment sequentially according to sequence of distances to the vertical well from short to long, wherein the perforated hole included in one segment is opened when a gas volume produced by the last adjacent segment of the segment in the horizontal branch is smaller than the pre-set gas volume, and the perforated hole included in one segment is closed when a gas volume produced by the perforated hole which is included in the segment and when in an open state is smaller than the pre-set gas volume.

Optionally, a horizontal distance from the vertical well to the toe end of the horizontal well is within a range from 20 m to 100 m.

Optionally, the pre-set value is within a range from 3 to 6.

Optionally, a depth of the horizontal branch is within a range from ⅕ of a depth of the natural gas hydrate reservoir to ⅓ of a depth of the natural gas hydrate reservoir.

Optionally, the bottom of the vertical well perforation segment is the bottom of the natural gas hydrate reservoir, and the top of the vertical well perforation segment is located in a range from ½ of a depth of the natural gas hydrate reservoir to ⅔ of a depth of the natural gas hydrate reservoir.

Optionally, the pre-set rate is within a range from 20 $m^3/d$ to 200 $m^3/d$.

Optionally, the pre-set pressure is within a range from 2 MPa to 6 MPa.

Optionally, the pre-set gas volume is within a range from 500 $m^3/d$ to 2000 $m^3/d$.

Optionally, an effective thickness of the natural gas hydrate reservoir is greater than 20 m.

Through the technical scheme, as a heat flow is injected by virtue of the vertical well to heat the natural gas hydrate reservoir and heated exploitation for regions with different permeability is carried out by controlling perforation region and perforation time of the horizontal branch of the horizontal well, a recovery ratio of the heterogeneous natural gas hydrate is improved greatly. In addition, the method is adaptive to exploitation of various heterogeneous natural gas hydrate reservoirs, makes full use of a horizontal well structure and reduces exploitation cost. Furthermore, the vertical well and the horizontal well used in the method are simple in structure and easy to control. Thus, the method provides effective measures for exploitation of the natural gas hydrate reservoir.

Other features and advantages of the invention will be described in detail in the following embodiment.

BRIEF DESCRIPTION OF DRAWINGS

The accompanying drawing is used for further understanding of example of implementation of the invention and constitutes a portion of the specification. The accompanying drawing, together with the following embodiment, is used for explaining example of implementation of the invention, but does not limit example of implementation of the invention. In the accompanying drawing, FIG. 1 is a structural diagram of a vertical well and a horizontal well in the method used for exploiting the natural gas hydrate reservoir, provided by one example of implementation of the invention.

Instructions of Marks of the Accompanying Drawing

| | | | |
|---|---|---|---|
| 1 | horizontal well | 2 | vertical well |
| 3 | sea level | 4 | natural gas hydrate reservoir |
| 5 | vertical well perforation segment | 6 | horizontal well perforation segment |
| 7 | perforation region I | 8 | perforation region II |
| 9 | perforation region III | 10 | perforation region IV |

DETAILED DESCRIPTION OF THE EMBODIMENTS

The embodiment of example of implementation of the invention is described in detail by combining with the accompanying drawings. What shall be understood is that the embodiment described here is only used for explaining and illustrating example of implementation of the invention, but does not limit the example of implementation of the invention.

The invention provides the method used for exploiting the natural gas hydrate reservoir. According to the method, a heat flow is injected into the natural gas hydrate reservoir by utilizing a vertical well to promote decomposition of the natural gas hydrate. Regions are divided based on permeability of the natural gas hydrate reservoir and a horizontal well is subjected to segmental perforation, so that heat exploitation of the heterogeneous natural gas hydrate reservoirs is realized.

Specifically, the method used for exploiting the natural gas hydrate reservoir comprises the following steps of: controlling a heat flow to enter a vertical well at a pre-set rate, wherein the vertical well drills through the natural gas hydrate reservoir and comprises a vertical well perforation segment and communicates with the natural gas hydrate reservoir through the vertical well perforation segment; controlling a horizontal well to exploit the natural gas hydrate reservoir at a pre-set well bottom pressure, wherein the pre-set well bottom pressure is lower than an original pressure of the natural gas hydrate reservoir by a pre-set pressure, the horizontal well is located at one side of the vertical well, and a horizontal branch of the horizontal well comprises a horizontal well perforation segment and communicates with the natural gas hydrate reservoir through the horizontal well perforation segment; when a gas volume produced by the horizontal well is lower than a pre-set gas volume, segmenting the horizontal branch and determining length of each segment of horizontal branch based on a permeability distribution of the natural gas hydrate reservoir and clustering analysis method, wherein the number of the segmented segments is a pre-set value; controlling perforated holes included in a first segment of the horizontal branch which is closest to the vertical well to be in an open state and controlling perforated holes included in other segments, except for the first segment, to be in a closed state, wherein the rate of injecting the heat flow into the vertical well is kept unchanged, and the exploitation of the natural gas hydrate reservoir in the first segment is carried out at the pre-set well bottom pressure; and starting from the first segment, controlling opening and/or closing state of the perforated holes included in each segment sequentially according to sequence of distances to the vertical well from short to long, wherein the perforated hole included in one segment is opened when a gas volume produced by the last adjacent segment of the segment in the horizontal branch is smaller than the pre-set gas volume, the perforated hole included in one segment is closed when a gas volume produced by the perforated hole which is included in the segment and when in an open state is smaller than the pre-set gas volume, the rate of injecting the heat flow into the vertical well is kept unchanged, and the exploitation of the natural gas hydrate reservoir in each segment is carried out at the pre-set well bottom pressure.

As a heat flow is injected by virtue of the vertical well to heat the natural gas hydrate reservoir and heated exploitation for regions with different permeability is carried out by controlling perforation region and perforation time of the horizontal branch of the horizontal well, a recovery ratio of the heterogeneous natural gas hydrate is improved greatly. In addition, the method is adaptive to exploitation of various heterogeneous natural gas hydrate reservoirs, makes full use of a horizontal well structure and reduces exploitation cost; furthermore, the vertical well and the horizontal well used in the method are simple in structure and easy to control. Thus, the method provides effective measures for exploitation of the natural gas hydrate reservoir.

Optionally, a horizontal distance from the vertical well to the toe end of the horizontal well in the example of implementation of the invention is within a range of from 20 m to 100 m. Therefore, the heat flow injected into the vertical well is prevented from channeling into the horizontal well.

Optionally, the pre-set value in the example of implementation of the invention is within a range from 3 to 6.

Optionally, a depth of the horizontal branch in the example of implementation of the invention is within a range from ⅕ of a depth of the natural gas hydrate reservoir to ⅓ of a depth of the natural gas hydrate reservoir.

Optionally, the bottom of the vertical well perforation segment in the example of implementation of the invention is the bottom of the natural gas hydrate reservoir, and the top of the vertical well perforation segment is located in a range from ½ of a depth of the natural gas hydrate reservoir to ⅔ of a depth of the natural gas hydrate reservoir.

Optionally, the pre-set rate in the example of implementation of the invention is within a range from 20 $m^3$/d to 200 $m^3$/d.

Optionally, the pre-set pressure in the example of implementation of the invention is within a range of from 2 MPa to 6 MPa.

Optionally, the pre-set gas volume in the example of implementation of the invention is within a range from 500 $m^3$/d to 2000 $m^3$/d.

Optionally, an effective thickness of the natural gas hydrate reservoir is greater than 20 m.

The FIG. 1 is a structure diagram of a vertical well and a horizontal well in the method used for exploiting the natural gas hydrate reservoir, provided by one example of implementation of the invention. The method used for exploiting the natural gas hydrate reservoir, provided by one example of implementation of the invention is illustrated by combining with FIG. 1; and specifically, the method comprises the following content.

Step 1, selecting a natural gas hydrate reservoir 4 with an average effective thickness of 25 m based on natural gas hydrate reservoir geological data; and drilling a vertical well 2, wherein the vertical well 2 completely drills through the natural gas hydrate reservoir 4, a vertical well perforation segment 5 covers the place from the bottom of the natural gas hydrate reservoir 4 to ⅔ of a depth of the natural gas hydrate reservoir 4 in the vertical well 2.

Step 2, drilling a horizontal well 1 at one side of the vertical well 2, wherein a heel end of the horizontal well 1 is a far end of the vertical well 2, that is, the heel end is one end far away from the vertical well 2 in the horizontal well 1, a toe end of the horizontal well 1 is a near end of the vertical well 2, that is, the toe end is one end close to the vertical well 2 in the horizontal well 1, in order to prevent the heat water injected into the vertical well 2 from channeling to the horizontal well 1, a horizontal distance between the vertical well 2 and the toe end of the horizontal well 1 is 40 m, a depth of the horizontal branch of the horizontal well 1 is ⅕ of a depth of the natural gas hydrate reservoir 4, and the whole horizontal branch of the horizontal well 1 communicates with the natural gas hydrate reservoir 4 through a horizontal well perforation segment 6.

Step 3, injecting a heat flow into the vertical well 2 at a rate of 100 $m^3$/d, and exploiting the horizontal well 1 by keeping the well bottom pressure lower than the original pressure of the natural gas hydrate reservoir by 4 MPa.

Step 4, when a gas volume produced by the horizontal well 1 is lower than 500 $m^3$/d, designing segmentation number of the horizontal branch of the horizontal well 1 and length of each segment by adopting a clustering analysis method based on a permeability distribution of the natural gas hydrate reservoir 4; the designed segmentation number of the horizontal well is 4, and the horizontal branch is divided into 4 segments, respectively including, a perforation region I 7, a perforation region II 8, a perforation region III 9 and a perforation region IV 10; the clustering analysis method is an existing method, and the specific implementation process can refer to references: Ma Liping.clustering analysis method [J].data, 2000(5):36-37. The clustering analysis method has the advantages of small required memory, fast calculation rate, etc.

Step 5, keeping rate of injecting the heat flow into the vertical well 2 unchanged, keeping perforated hole(s) included in the perforation region IV 10 which is closest to the vertical well 2 being in an open state and sealing perforated hole(s) respectively included in the perforation region I 7, the perforation region II 8 and the perforation region DI 9, and exploiting the natural gas hydrate reservoir at a well bottom pressure lower than the original pressure of the natural gas hydrate reservoir by 4 MPa in the perforation region IV 10.

Step 6, when a gas volume produced by the perforation region IV 10 is lower than 500 $m^3$/d, sealing perforated hole(s) included in the perforation region IV 10 and opening perforated hole(s) in the perforation region DI 9 which is adjacent to the perforation region IV 10 and is close to the heel end, and exploiting the natural gas hydrate reservoir at a well bottom pressure lower than the original pressure of the natural gas hydrate reservoir 4 by 4 MPa in the perforation region DI 9.

Step 7, repeating the step 6 of performing natural gas hydrate reservoir exploitation from the toe end of the horizontal well 1 to the heel end in a segmented manner, and when a gas volume produced by perforation region I 7 which is closest to the heel end is lower than 500 $m^3$/d, stopping exploiting.

In conclusion, as a heat flow is injected by virtue of the vertical well to heat the natural gas hydrate reservoir and heated exploitation for regions with different permeability is carried out by controlling perforation region and perforation time of the horizontal branch of the horizontal well, a recovery ratio of the heterogeneous natural gas hydrate is improved greatly. In addition, the method is adaptive to exploitation of various heterogeneous natural gas hydrate reservoirs, makes full use of a horizontal well structure and reduces exploitation cost. Furthermore, the vertical well and the horizontal well used in the method are simple in structure and easy to control, so the method provides effective measures for exploitation of the natural gas hydrate reservoir. Moreover, a horizontal distance from the vertical well to the toe end of the horizontal well is designed to be within a range from 20 m to 100 m, so that the heat flow injected into the vertical well is prevented from channeling into the horizontal well.

The optional embodiment of example of implementation of the invention is described in detail by combining with the accompanying drawing abovementioned. However, the example of implementation of the invention is not limited to the specific details in the embodiment, within the technical design scope of the example of implementation of the invention, multiple simple transitions of the technical scheme of the example of implementation of the invention can be carried out, and these single transitions belong to the scope of protection of the example of implementation of the invention.

What needs to be explained additionally is that the specific technical features described in the embodiment can be combined through any suitable mode in the presence of no contradictions. In order to avoid unnecessary repetition, the example of implementation of the invention no longer illustrates various possible combined modes.

Technicians in the field may understand that all or partial steps for realizing the method of the example of implementation can be finished by a program commanding related hardware; the program is stored in a storage medium, including, multiple instructions used for enabling a single-chip machine, a chip or a processor to carry out all or partial steps of the method of each example of implementation. The storage medium comprises various media which can store program codes, such as a USB flash disk, a mobile hard disk, a ROM (Read-Only Memory), a RAM (Random Access Memory), a magnetic disk or an optical disk.

In addition, different embodiment of the example of implementation of the invention also can be combined randomly and shall be regarded as content disclosed by the example of implementation of the invention as long as the combination complies with the idea of the example of implementation of the invention.

The invention claimed is:

1. A method used for exploiting a natural gas hydrate reservoir, comprising:

controlling a heat flow to enter a vertical well at a pre-set rate, wherein the vertical well drills through the natural gas hydrate reservoir and comprises a vertical well perforation segment and communicates with the natural gas hydrate reservoir through the vertical well perforation segment, wherein the pre-set rate is within a range from 20 $m^3$/d to 200 $m^3$/d;

controlling a horizontal well to exploit the natural gas hydrate reservoir at a pre-set well bottom pressure, wherein the pre-set well bottom pressure is lower than an initial pressure of the natural gas hydrate reservoir by a pre-set pressure, the horizontal well is located at one side of the vertical well, a horizontal branch of the horizontal well comprises a horizontal well perforation segment and communicates with the natural gas hydrate reservoir through the horizontal well perforation segment, wherein the pre-set pressure is within a range from 2 MPa to 6 MPa;

on the condition that a gas volume produced by the horizontal well is lower than a pre-set gas volume, segmenting the horizontal branch and determining length of each segment of the horizontal branch based on a permeability distribution of the natural gas hydrate reservoir and clustering analysis method, wherein the number of the segmented segments is a pre-set value, and the pre-set gas volume is within a range from 500 $m^3/d$ to 2000 $m^3/d$;

controlling perforated holes included in a first segment of the horizontal branch which is closest to the vertical well to be in an opening state and controlling perforated holes included in other segments, except for the first segment, to be in a closing state; and starting from the first segment, controlling an open state and closed state of the perforated holes included in each segment sequentially according to sequence of distances to the vertical well from short to long, wherein a gas volume produced by the last adjacent segment of the segment in the horizontal branch that is smaller than the pre-set gas volume causes the perforated hole included in one segment to open and wherein a gas volume produced by the perforated hole which is included in the segment and is in an open state is smaller than the pre-set gas volume, causes the perforated hole included in one segment to close.

2. The method according to claim 1, wherein a horizontal distance from the vertical well to the toe end of the horizontal well is within a range from 20 m to 100 m.

3. The method according to claim 1, wherein the pre-set value for the number of segmented segments is within a range from 3 to 6.

4. The method according to claim 1, wherein a depth of the horizontal branch is within a range from ⅕ of a depth of the natural gas hydrate reservoir to ⅓ of a depth of the natural gas hydrate reservoir.

5. The method according to claim 1, wherein the bottom of the vertical well perforation segment is the bottom of the natural gas hydrate reservoir, and the top of the vertical well perforation segment is located in a range from ½ of a depth of the natural gas hydrate reservoir to ⅔ of a depth of the natural gas hydrate reservoir.

6. The method according to claim 1, wherein an effective thickness of the natural gas hydrate reservoir is greater than 20 m.

* * * * *